US008225566B2

(12) United States Patent
Prevost et al.

(10) Patent No.: US 8,225,566 B2
(45) Date of Patent: Jul. 24, 2012

(54) TILE FOR A SYNTHETIC GRASS SYSTEM

(75) Inventors: Jean Prevost, Westmount (CA); Stephen Murphy, Ile Bizard (CA)

(73) Assignee: Fieldturf Tarkett Inc. (CA)

( * ) Notice: Subject to any disclaimer, the term of this patent is extended or adjusted under 35 U.S.C. 154(b) by 381 days.

(21) Appl. No.: 11/973,645

(22) Filed: Oct. 9, 2007

(65) Prior Publication Data

US 2008/0216437 A1 Sep. 11, 2008

Related U.S. Application Data

(60) Provisional application No. 60/862,747, filed on Oct. 24, 2006, provisional application No. 60/828,725, filed on Oct. 9, 2006.

(51) Int. Cl.
*E04B 2/08* (2006.01)

(52) U.S. Cl. ..... 52/302.1; 52/177; 52/392; 52/581; 52/589.1

(58) Field of Classification Search ..... 52/177, 52/302.1, 390, 392, 581, 589.1, 591.1, 388, 52/71; 47/1.01 F, 9, 20.1, 21.1, 25.1, 31, 47/31.1, 32, 32.7; 404/32, 34, 35, 36; 405/36, 405/43; 428/53, 54

See application file for complete search history.

(56) References Cited

U.S. PATENT DOCUMENTS 3,077,059 A * 2/1963 Stout ..... 52/388
3,319,392 A * 5/1967 Fitzgerald ..... 52/389
3,332,828 A 7/1967 Faria et al.
3,438,312 A * 4/1969 Becker et al. ..... 404/40
3,740,303 A 6/1973 Alderson et al.
3,995,079 A 11/1976 Haas
4,044,179 A 8/1977 Haas
4,389,435 A 6/1983 Haas
4,396,653 A 8/1983 Tomarin
4,405,665 A 9/1983 Beaussier
4,421,439 A 12/1983 ter Burg et al.
4,472,086 A 9/1984 Leach
4,535,021 A 8/1985 Friedrich
4,584,221 A * 4/1986 Kung ..... 428/44
4,590,731 A * 5/1986 DeGooyer ..... 52/581
4,735,825 A 4/1988 Friedrich
4,735,828 A 4/1988 Cogswell et al.
4,815,892 A 3/1989 Martin
4,930,286 A * 6/1990 Kotler ..... 52/177
5,190,799 A * 3/1993 Ellingson, III ..... 428/53
5,215,802 A * 6/1993 Kaars Sijpesteijn ..... 428/100
5,255,998 A 10/1993 Beretta
5,323,575 A * 6/1994 Yeh ..... 52/177
5,383,314 A 1/1995 Rothberg
5,406,745 A * 4/1995 Lin ..... 47/1.01 F
(Continued)

FOREIGN PATENT DOCUMENTS

AU 656435 2/1995
(Continued)

*Primary Examiner* — Robert Canfield
*Assistant Examiner* — Brent W Herring
(74) *Attorney, Agent, or Firm* — Factor Intellectual Property Law Group, Ltd.

(57) ABSTRACT

A tile for a synthetic grass system having a top surface with a plurality of trusses, a bottom surface with a plurality of legs extending therefrom. The trusses intersect and form apertures. The top surface has a plurality of sections which are hingedly attached to adjacent sections with expansion members.

19 Claims, 3 Drawing Sheets

U.S. PATENT DOCUMENTS

| | | | | |
|---|---|---|---|---|
| 5,460,867 | A | 10/1995 | Magnuson et al. | |
| 5,486,392 | A * | 1/1996 | Green | 428/54 |
| 5,527,128 | A * | 6/1996 | Rope et al. | 404/35 |
| 5,601,886 | A | 2/1997 | Ishikawa et al. | |
| 5,628,160 | A * | 5/1997 | Kung | 52/591.1 |
| 5,651,641 | A | 7/1997 | Stephens et al. | |
| 5,833,386 | A * | 11/1998 | Rosan et al. | 404/36 |
| 5,958,527 | A | 9/1999 | Prévost | |
| 5,958,538 | A | 9/1999 | Kessler | |
| 5,958,540 | A | 9/1999 | Berard et al. | |
| 5,976,645 | A | 11/1999 | Daluise et al. | |
| 5,992,106 | A * | 11/1999 | Carling et al. | 52/177 |
| 6,042,915 | A | 3/2000 | Kessler | |
| 6,098,354 | A * | 8/2000 | Skandis | 52/177 |
| 6,127,015 | A | 10/2000 | Kessler | |
| 6,171,984 | B1 | 1/2001 | Paulson et al. | |
| 6,221,445 | B1 | 4/2001 | Jones | |
| 6,299,959 | B1 | 10/2001 | Squires et al. | |
| 6,330,762 | B1 * | 12/2001 | Puspurs | 47/9 |
| 6,428,870 | B1 | 8/2002 | Bohnhoff | |
| 6,467,224 | B1 * | 10/2002 | Bertolini | 52/177 |
| 6,527,889 | B1 | 3/2003 | Paschal et al. | |
| 6,751,912 | B2 * | 6/2004 | Stegner et al. | 52/177 |
| 6,802,159 | B1 * | 10/2004 | Kotler | 52/177 |
| 6,877,932 | B2 | 4/2005 | Prévost | |
| 7,090,430 | B1 * | 8/2006 | Fletcher et al. | 404/35 |
| 7,114,298 | B2 * | 10/2006 | Kotler | 52/177 |
| D532,530 | S * | 11/2006 | Shuman et al. | D25/163 |
| 7,341,401 | B2 * | 3/2008 | Blackwood | 405/36 |
| 7,364,383 | B2 * | 4/2008 | Fletcher et al. | 404/35 |
| 7,571,573 | B2 * | 8/2009 | Moller, Jr. | 52/177 |
| 7,587,865 | B2 * | 9/2009 | Moller, Jr. | 52/181 |
| 7,748,177 | B2 * | 7/2010 | Jenkins et al. | 52/177 |
| 7,774,991 | B2 * | 8/2010 | Fletcher et al. | 52/71 |
| 2003/0089051 | A1 * | 5/2003 | Bertolini | 52/177 |
| 2004/0058096 | A1 | 3/2004 | Prevost | |
| 2005/0016088 | A1 * | 1/2005 | Pursall et al. | 52/177 |
| 2005/0193669 | A1 * | 9/2005 | Jenkins et al. | 52/392 |
| 2005/0223666 | A1 | 10/2005 | Forster et al. | |
| 2005/0277490 | A1 * | 12/2005 | Allen | 473/415 |
| 2006/0070314 | A1 * | 4/2006 | Jenkins et al. | 52/177 |
| 2008/0052986 | A1 * | 3/2008 | Son et al. | 47/31.1 |

FOREIGN PATENT DOCUMENTS

| | | |
|---|---|---|
| CA | 2102460 | 5/1995 |
| CA | 2206839 | 7/1996 |
| CA | 2218314 | 9/1998 |
| CH | 670572 | 6/1989 |
| DE | 19521944 | 12/1995 |
| DE | 29604175 U | 6/1997 |
| EP | 0185645 | 6/1986 |
| EP | 0455260 | 11/1991 |
| FR | 2277172 | 1/1976 |
| JP | 59195907 | 11/1984 |
| JP | 60223506 | 11/1985 |
| JP | 63064738 | 3/1988 |
| JP | 05056724 A * | 3/1993 |
| JP | 7229039 | 8/1995 |
| JP | 8049209 | 2/1996 |
| JP | 9057883 | 3/1997 |
| JP | 9164617 | 6/1997 |
| NL | 1007042 C | 3/1998 |

* cited by examiner

FIG. 2
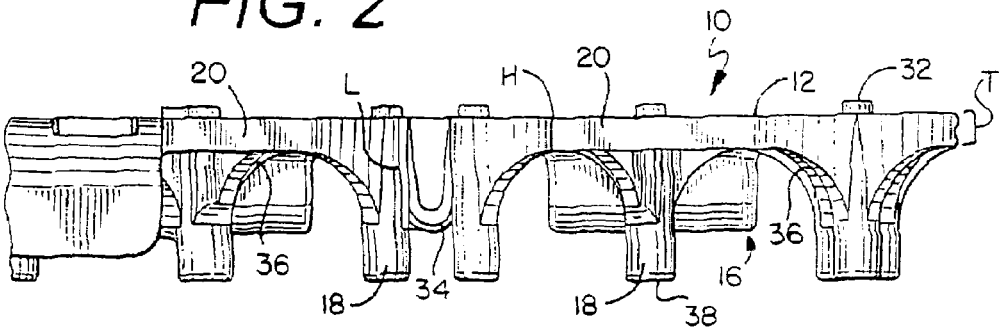
FIG. 3
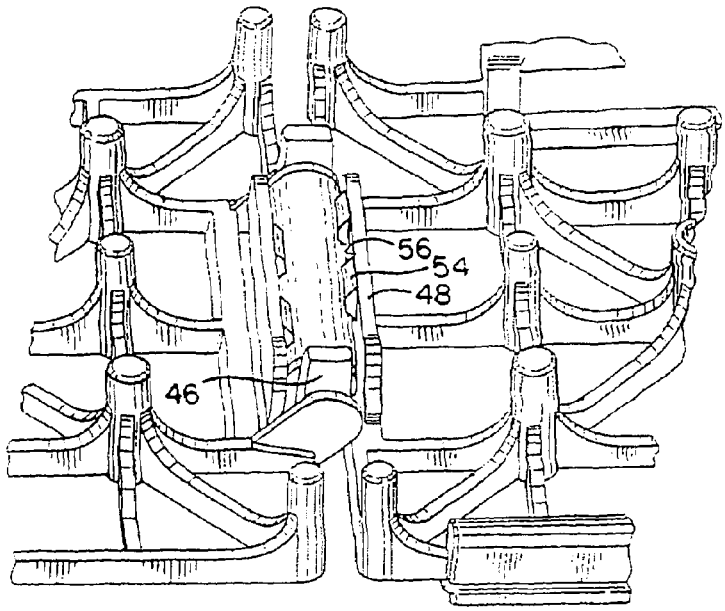
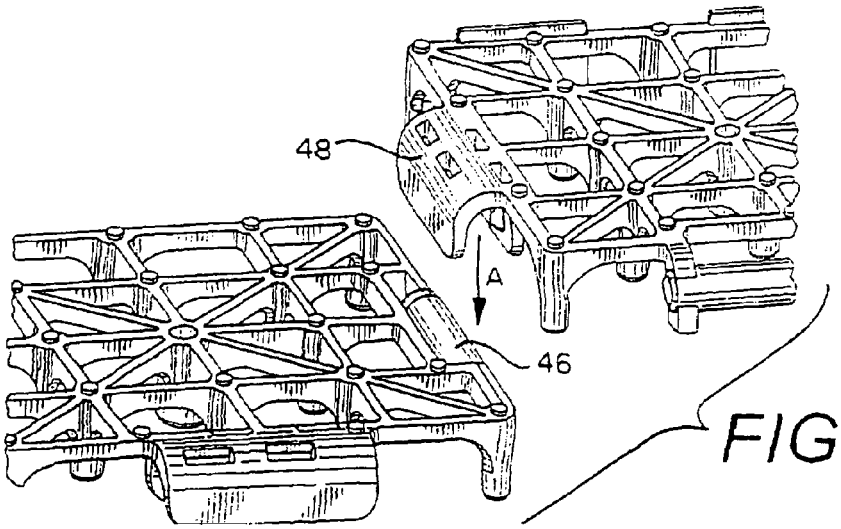
FIG. 5

TILE FOR A SYNTHETIC GRASS SYSTEM

RELATED APPLICATIONS

This application claims the benefit of the filing date of U.S. Provisional Application Ser. No. 60/862,747 filed on Oct. 24, 2006. This application also claims the benefit of the filing date of U.S. Provisional Application Ser. No. 60/828,725 filed on Oct. 9, 2006. Both provisional applications are incorporated by reference herein.

DESCRIPTION

The present invention relates to synthetic grass systems, and more particularly to tiles used in a synthetic grass systems.

BACKGROUND OF THE INVENTION

Beneath a synthetic grass system it is not uncommon to utilize a drainage system. These drainage systems include, among other things, an array of tiles.

Utilizing tiles beneath a synthetic grass system has multiple benefits. For example, tiles can be utilized to aide in drainage by maximizing the distance between the synthetic grass system and the base, typically which comprises crushed stone. The added space allows water to drain from the synthetic grass system to the base without flooding the synthetic grass system.

Additionally, utilizing a tile beneath a synthetic grass system can increase the shock absorbing characteristics of the synthetic grass system. It is important for safety that the synthetic grass system maintains a certain level of "give." A tile can add to the shock absorbing characteristics of the synthetic grass system through utilization of a material that is slightly flexible—especially when compared to the crushed stone base beneath the tiles.

While the conventionally used bases and tiles are believed to be generally effective for their intended purposes, there remains a need for a tile that provides additional benefits over the conventionally used tiles.

SUMMARY OF THE INVENTION

Aspects of the present invention are intended to solve some of the problems associated with the conventions tiles.

In one aspect of the invention, the invention relates to a tile which has improved drainage characteristics. This may be accomplished by utilizing a thinner top surface and longer and fewer legs than conventional tiles.

In another aspect of the invention, the invention relates to a tile which has a lower weight but yet provides the sufficient structural strength required in, for example, a synthetic grass system. This may also be accomplished by utilizing a thinner top surface and longer and fewer legs than conventional tiles.

In yet another aspect of the present invention, the invention provides a tile with increased flexibility and thermal expansion. Since the tile will be subject to high temperatures and physical forces, it is desirable to have a tile which can accommodate these factors. This may be accomplished by utilizing expansion members between the sections of a tile and/or receiving channels and attaching bars as means for connecting a tile with adjacent tiles.

Another aspect of the present invention, the invention provides a tile that takes less time to install. This may be accomplished by utilizing inverted receiving channels and attaching bars as the means for connecting a tile with adjacent tiles.

Other benefits of these aspects of the present invention will be readily apparent to one of ordinary skill in the art after reading the description of the invention and drawings herewith.

DESCRIPTION OF THE DRAWINGS

FIG. 2 is side perspective view of an embodiment of a tile according to the present invention.

FIG. 3 is bottom view of a connection between an attaching bar and receiving channel according to the present invention

FIG. 5 is a side perspective view of an attaching bar and receiving channel according to the present invention just prior to being connected.

DETAILED DESCRIPTION OF THE PREFERRED EMBODIMENTS

Figure 1:
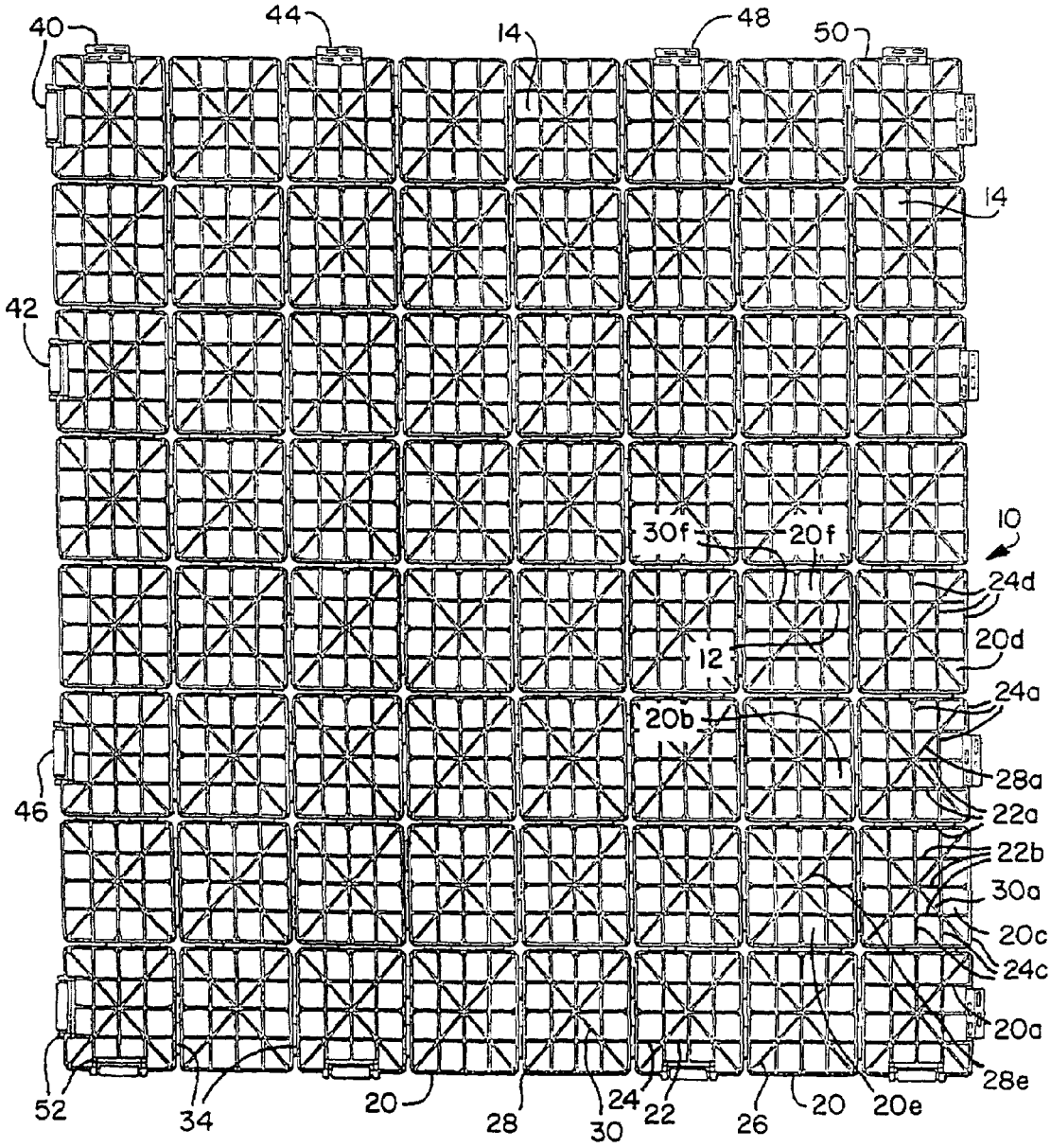
FIG. 1 is top view of one embodiment of a tile according to the present invention.
Figure 4:
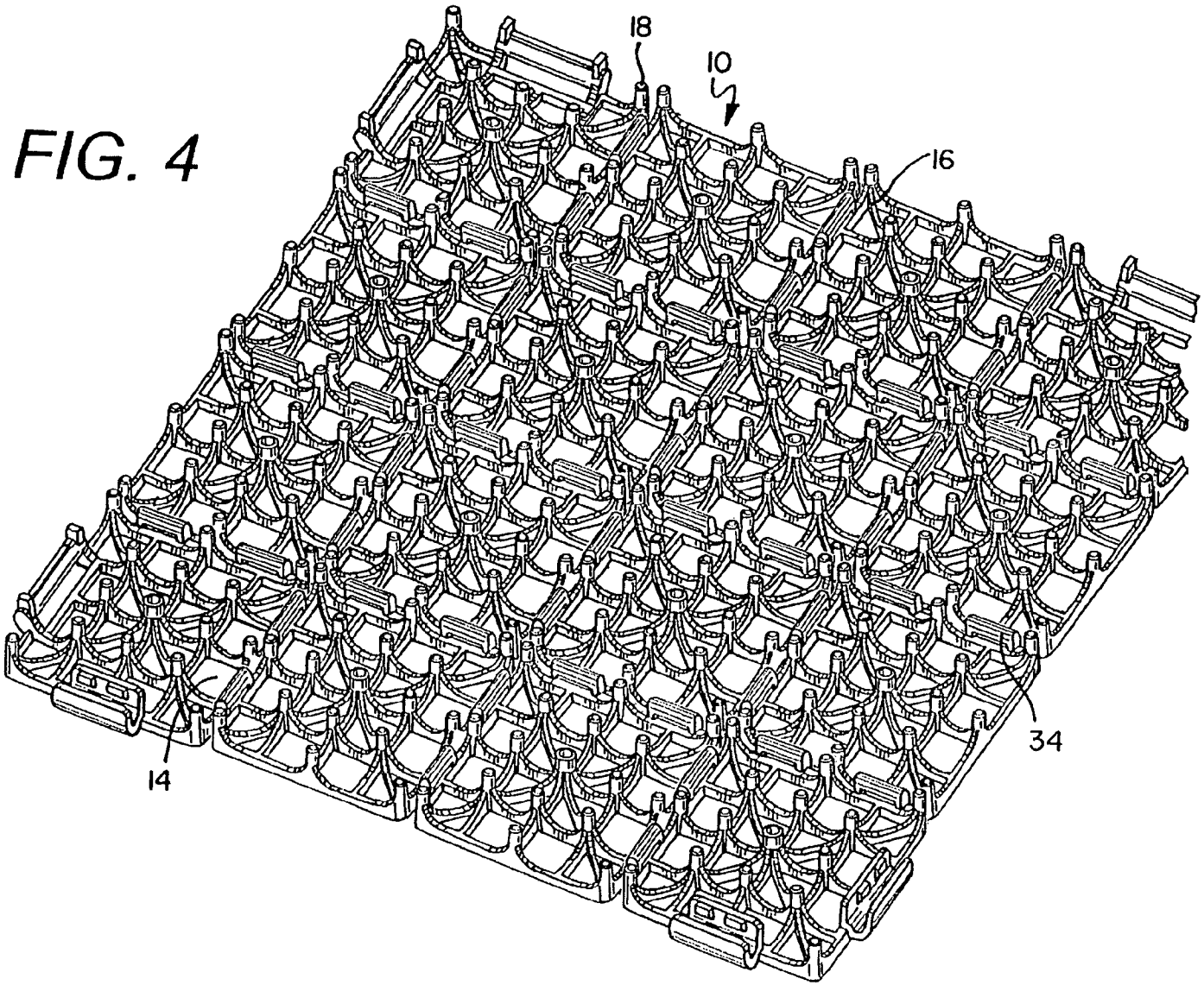
FIG. 4 is a bottom view of an embodiment of a tile according to the present invention.

While this invention is susceptible of embodiment in many different forms, there is shown in the drawings and will be described in detail below, specific embodiments with the understanding that the present disclosure is to be considered as an exemplification of the principles of the invention and is not intended to limit the invention to the embodiments illustrated.

It should be understood that like or analogous elements and/or components, referred to herein, are identified throughout the drawings by like reference characters. In addition, it should be understood that the drawings are merely a representation, and some of the components may have been distorted from actual scale for purposes of pictorial clarity.

A tile 10 according to the present invention, for use with a synthetic grass system, includes a top surface 12 having a plurality of apertures 14 and a thickness T, a bottom surface 16 with a plurality of legs 18 extending therefrom. It is contemplated that the tile 10 is made from a composition comprising a thermoplastic and rubber mixture, which would have additional benefits, such as flexibility.

In a preferred embodiment the top surface 12 of the tile 10 comprises a plurality of sections 20. Each section 20 includes horizontal trusses 22 and vertical trusses 24. Additionally, the sections 20 may also include a diagonal truss 26, and in the preferred embodiment, include a first diagonal truss 28 and a second diagonal truss 30 which intersect. The trusses 22, 24, 26, 28, 30 intersect, and form the apertures 14.

In a preferred embodiment, the trusses of each section substantially align with trusses from adjacent sections. Thus, for example, a first section 20*a* includes horizontal trusses 22*a*, vertical trusses 24*a*, first diagonal truss 28*a* and a second diagonal truss 30*a*. The horizontal trusses 22*a* are substantially aligned with horizontal trusses 22*b* of an adjacent section 20*b*. The vertical trusses 24*a* are substantially aligned with vertical trusses 24*c*, 24*d* of adjacent sections 20*c*, 20*d* respectively. The first diagonal truss 28*a* is substantially aligned with diagonal truss 28*e* from adjacent sections 20*e*. The second diagonal truss 30*a* is substantially aligned with diagonal trusses 30*f* from adjacent section 20*f*. Thus, horizontal trusses 22*a* from a first section 20*a* are substantially aligned with the horizontal trusses 22*b* in adjacent sections 20*b* in the horizontal direction. Similarly, vertical trusses 24*a* from a first section 20*a* are substantially aligned with the vertical trusses 24*c*, 24*d* in adjacent sections 20*c*, 20*d* in the vertical direction. Finally, the first diagonal truss 28*a* and second diagonal truss 30*a* are substantially aligned with respective first diagonal truss 28*e* and second diagonal truss 30*f* in adjacent sections 20*e*, 30*f* in the respective diagonal direction.

Furthermore, in a preferred embodiment small bumps 32 are provided on the top surface 12 to aid in maintaining the position of the synthetic grass system disposed on the top surface 12.

Additionally, in the preferred embodiment the tile 10 measures 2 feet by 2 feet and includes 64 sections 20.

It is also preferred that the sections 20 are hingedly connected to adjacent sections 20. By hingedly connected, it is meant that there is some flexibility between the adjacent sections 20. This will increase the flexibility of the entire arrangement of tiles 10 (i.e., an array). It is also preferred that the sections 20 be hingedly connected through the use of an expansion member 34, which may or may not be integrally formed with the sections 20. In the preferred embodiment, expansion member 34 has a u-shape and has a length L less than the height H of the legs 18. In the preferred embodiment it is preferred that two expansion members 34 are used for each connection between adjacent sections 20. Thus, if there are 64 sections 20 there will be 112 expansion members 34.

The thickness T of the top surface 12 is approximately 1.5 times thinner than one of the conventionally used base tiles. Specifically, one conventional tile has a top surface with a thickness of 5.5 mm, while a preferred tile 10 according to the present invention has a top surface thickness T of 3.5 mm.

As previously mentioned the bottom surface 16 has a plurality of legs 18 extending away therefrom. In a preferred embodiment, the length L of the legs 18 is at least 1.5 times the thickness T of the top surface 12 and may or may not be integrally formed with the tile 10. Compared to the legs of one conventional tile, the legs 18 of the tile 10 according to the present invention are approximately 1.25 times longer. The conventional tile leg has a length of 7.8 mm, while a preferred tile 10 according to the present invention has a leg 18 with a length L of 9.8 mm.

In a preferred embodiment the legs 18 are separated from adjacent legs 18 by arched supports 36. Further, in the preferred embodiment, the bottom of the legs 38 is slightly beveled. This is especially beneficial when a geo-textile fabric is placed between the stone base and tile to avoid penetrating, tearing or ripping the geo-textile fabric.

Utilizing a thinner top surface and longer legs is beneficial compared to some of the conventionally used tiles. First, the thinner top surface and longer legs increases the volume of space beneath the bottom surface. This increase in volume can aide in drainage characteristics by providing additional space for water to drain. An additional benefit is a lowered weight without compromising the structural strength of the tile (it is believed that a tile need a strength of 120 psi). One of the conventionally used tiles has a weight of approximately 3.30 lbs with a strength of approximately 338 psi, while a preferred tile according to the present invention has a weight of between 1.40 lbs and 1.61 lbs and a strength of 193 psi. This lower weight provides a tile that is easier to handle during installation. Additionally, the lower weight allows for tiles for one field (approximately 85,000 $ft^2$) to be made in one shipment within one semi-truck trailer.

Around the tile 10 means for connecting the tiles with adjacent tiles 40 are provided. The means 40 may include clips and loops, male connectors 42 and female connectors 44, attaching bars 46 and receiving channels 48, snaps, locking members, and any other structure known to those of skill in the art.

It is preferred that a first set of adjacent sides 50 of the tile 10 have one type of the means for connecting 40 and a second set of adjacent side 52 will have a complementary configured means for connecting 40. In the preferred embodiment, the means for connecting 40 are male connectors 42 and female connectors 44, and in a more preferred embodiment, the means for connecting 40 are an attaching bar 46 and receiving channel 48. The receiving channels 48 may be u-shaped, or, as in the preferred embodiment an inverted u-shape. The inverted u-shape allows adjacent tiles 10 to be connected by merely pushing the receiving channel 48 down (in the direction of arrow A) onto the attaching bar 46. This can save time during the installation process. Additionally, it is preferred that the receiving channels 48 include protrusions 54 on the inner surface 56 thereof. The protrusions 54 will aide in frictionally maintaining the connection between the attaching bar 46 and receiving channel 48.

One of the benefits of utilizing the attaching bar 46 and receiving channel 48 is increased flexibility of the array of fields. When the attaching bar 46 is disposed in the receiving channel 48, the tiles 10 will be able to be rotated or flexed relative to each other. This increased flexibility is beneficial to the synthetic grass system.

In the preferred embodiment (wherein the tile measures 2 feet by 2 feet), eight (8) attaching bars 46/receiving channels 48 are disposed on each side of the tile 10.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

What is claimed is:

1. A tile for use with a synthetic grass system, the tile comprising:

a plurality of sections having a top surface, the top surface of each section having a plurality of horizontal trusses and vertical trusses and a first diagonal truss and a second diagonal truss, the first diagonal truss intersecting the second diagonal truss; and, a first set of adjacent sides and a second set of adjacent sides, the first set of adjacent sides having a plurality of inverted u-shaped receiving channels and the second set of adjacent sides having a plurality of attaching bars being configured complimentary to the receiving channels; and, each section from the plurality of sections being hingedly attached to an adjacent section by at least one u-shaped expansion member integrally formed within the tile, wherein each u-shaped expansion member extends away from the top surface and includes a rounded bottom, and the horizontal trusses, the vertical trusses, the first diagonal truss and the second diagonal truss from each section substantially aligning with the respective horizontal trusses, vertical trusses, first diagonal truss and second diagonal truss of the adjacent sections.

2. The tile of claim 1, further comprising the top surface having a thickness, and a plurality of legs extending away from a bottom surface of the tiles, the legs each having a height at least 1.5 times the thickness.

3. The tile of claim 2 further comprising, the legs from the plurality of legs being separated from adjacent legs by an arched support.

4. The tile of claim 1 further comprising a plurality of protrusions positioned on an inner surface of the receiving channels.

5. The tile of claim 1 wherein the tile is comprised of a mixture of a thermoplastic and a rubber.

6. A tile for use with a synthetic grass system, the tile comprising:

a top surface and a bottom surface, the top surface having a plurality of sections and the bottom surface having a plurality of legs extending therefrom, each section of the plurality of sections having a plurality of apertures and being hingedly attached to adjacent sections with an expansion member having a length less than a height of the legs wherein the expansion member is integrally formed with the tile and has a u-shape that extends away from the top surface and includes a rounded bottom; and, a first set of adjacent sides and a second set of adjacent sides, each side from the first set of adjacent sides including at least one integral male connector and each side from the second set of adjacent sides including at least one integral female connector having an inverted u-shape.

7. The tile of claim 6 further comprising the male connector being an attaching bar.

8. The tile of claim 6 wherein the tile is comprised of a mixture of a thermoplastic and a rubber.

9. The tile of claim 6 wherein the tile measures 2 feet by 2 feet.

10. The tile of claim 6 further comprising:

each section including a plurality of horizontal trusses and vertical trusses and a first diagonal truss and a second diagonal truss, the first diagonal truss intersecting the second diagonal truss.

11. The tile of claim 10 further comprising:

the horizontal trusses, the vertical trusses, the first diagonal truss and the second diagonal truss from each section substantially aligning with the respective horizontal trusses, vertical trusses, first diagonal truss and second diagonal truss of the adjacent sections.

12. The tile of claim 6, further comprising the top surface having a thickness, and a plurality of legs extending away from a bottom surface of the tiles, the legs each having a height at least 1.5 times the thickness.

13. The tile of claim 12 further comprising, the legs from the plurality of legs being separated from adjacent legs by an arched support.

14. A tile for use with a synthetic grass system, the tile comprising:

a plurality of sections having a top surface, the top surface of each section having a plurality of horizontal trusses and vertical trusses and a first diagonal truss and a second diagonal truss, the first diagonal truss intersecting the second diagonal truss, each section from the plurality of sections being hingedly attached to an adjacent section by at least one u-shaped expansion member integrally formed within the tile wherein the u-shaped expansion member extends away from the top surface and includes a rounded bottom, the horizontal trusses, the vertical trusses, the first diagonal truss and the second diagonal truss from each section substantially aligning with the respective horizontal trusses, vertical trusses, first diagonal truss and second diagonal truss of the adjacent sections, and wherein the tile has a weight between 1.40 lbs and 1.61 lbs, and a strength greater than 190 psi.

15. The tile of claim 14 further comprising the top surface having a thickness, and a plurality of legs extending away from a bottom surface of the tiles.

16. The tile of claim 15 wherein each leg has a height, the height being greater than a distance from the top surface to the rounded bottom of the u-shaped expansion member.

17. The tile of claim 15 further comprising, the legs from the plurality of legs being separated from adjacent legs by an arched support.

18. The tile of claim 14 further comprising:

a first set of adjacent sides and a second set of adjacent sides, each side from the first set of adjacent sides including at least one integral male connector and each side from the second set of adjacent sides including at least one integral female connector.

19. The tile of claim 18 further comprising the male connector being an attaching bar and the female connector having an inverted u-shape.

* * * * *